US010938110B2

(12) United States Patent
Hinman et al.

(10) Patent No.: US 10,938,110 B2
(45) Date of Patent: Mar. 2, 2021

(54) ELLIPTICITY REDUCTION IN CIRCULARLY POLARIZED ARRAY ANTENNAS

(71) Applicant: Mimosa Networks, Inc., Santa Clara, CA (US)

(72) Inventors: Brian Hinman, Los Gatos, CA (US); Paul Eberhardt, Santa Cruz, CA (US)

(73) Assignee: Mimosa Networks, Inc., Santa Clara, CA (US)

( * ) Notice: Subject to any disclaimer, the term of this patent is extended or adjusted under 35 U.S.C. 154(b) by 636 days.

(21) Appl. No.: 14/316,537

(22) Filed: Jun. 26, 2014

(65) Prior Publication Data

US 2015/0002335 A1 Jan. 1, 2015

Related U.S. Application Data

(60) Provisional application No. 61/841,187, filed on Jun. 28, 2013.

(51) Int. Cl.

| | |
|---|---|
| ***H01Q 11/08*** | (2006.01) |
| ***H01Q 21/24*** | (2006.01) |
| ***H01Q 21/20*** | (2006.01) |

(52) U.S. Cl.

CPC ..... *H01Q 11/08* (2013.01); *H01Q 21/20* (2013.01); *H01Q 21/24* (2013.01)

(58) Field of Classification Search

CPC ..... H01Q 3/34; H01Q 21/065; H01Q 21/067; H01Q 21/24; H01Q 21/245; H01Q 3/46; H01Q 21/205; H04B 1/0003; H04B 7/00417; H04B 7/0626

USPC ..... 342/363–366

See application file for complete search history.

(56) References Cited

U.S. PATENT DOCUMENTS

| | | | | |
|---|---|---|---|---|
| 2,735,993 A | | 2/1956 | Humphrey | |
| 3,182,129 A | | 5/1965 | Clark et al. | |
| D227,476 S | | 6/1973 | Kennedy | |
| 4,188,633 A | * | 2/1980 | Frazita | H01Q 3/34 342/372 |

(Continued)

FOREIGN PATENT DOCUMENTS

| | | |
|---|---|---|
| CN | 104335654 A | 2/2015 |
| CN | 303453662 S | 11/2015 |

(Continued)

OTHER PUBLICATIONS

E.W. Weisstein, Electric Polarization, http://scienceworld.wolfram.com/physics/ElectricPolarization.html, 2007.*

(Continued)

*Primary Examiner* — Bernarr E Gregory
*Assistant Examiner* — Fred H Mull
(74) *Attorney, Agent, or Firm* — Carr & Ferrell LLP

(57) ABSTRACT

Ellipticity reduction in circularly polarized array antennas is provided herein. An antenna array may include a processor that is configured to control a plurality of elements, each of the plurality of elements producing an elliptically polarized wave having an eccentricity value, the elliptically polarized wave traveling along a direction of propagation, wherein at least a portion of the plurality of elements are incrementally clocked around their direction of propagation, so that a combined output of the plurality of elements is substantially circularly polarized.

18 Claims, 7 Drawing Sheets

(56) References Cited

U.S. PATENT DOCUMENTS 4,402,566 A 9/1983 Powell et al.
D273,111 S 3/1984 Hirata et al.
4,543,579 A * 9/1985 Teshirogi ..... H01Q 21/24 342/365
4,562,416 A 12/1985 Sedivec
4,626,863 A 12/1986 Knop et al.
4,835,538 A 5/1989 McKenna et al.
4,866,451 A * 9/1989 Chen ..... H01Q 21/065 343/700 MS
4,893,288 A 1/1990 Maier et al.
4,903,033 A 2/1990 Tsao et al.
4,986,764 A 1/1991 Eaby et al.
5,015,195 A 5/1991 Piriz
5,087,920 A * 2/1992 Tsurumaru ..... H01Q 21/0081 343/700 MS
5,226,837 A 7/1993 Cinibulk et al.
5,231,406 A * 7/1993 Sreenivas ..... H01Q 21/24 343/700 MS
D346,598 S 5/1994 McCay et al.
D355,416 S 2/1995 McCay et al.
5,389,941 A 2/1995 Yu
5,491,833 A 2/1996 Hamabe
5,513,380 A 4/1996 Ivanov et al.
5,539,361 A 7/1996 Davidovitz
5,561,434 A 10/1996 Yamazaki
D375,501 S 11/1996 Lee et al.
5,580,264 A 12/1996 Aoyama et al.
5,684,495 A 11/1997 Dyott et al.
D389,575 S 1/1998 Grasfield et al.
5,724,666 A 3/1998 Dent
5,742,911 A 4/1998 Dumbrill et al.
5,746,611 A 5/1998 Brown et al.
5,764,696 A 6/1998 Barnes et al.
5,797,083 A 8/1998 Anderson
5,831,582 A 11/1998 Muhlhauser et al.
5,966,102 A 10/1999 Runyon
5,995,063 A 11/1999 Somoza et al.
6,014,372 A 1/2000 Kent et al.
6,067,053 A * 5/2000 Runyon ..... H01Q 21/245 343/700 MS
6,137,449 A 10/2000 Kildal
6,140,962 A 10/2000 Groenenboom
6,176,739 B1 1/2001 Denlinger et al.
6,216,266 B1 4/2001 Eastman et al.
6,271,802 B1 8/2001 Clark et al.
6,304,762 B1 10/2001 Myers et al.
D455,735 S 4/2002 Winslow
6,421,538 B1 7/2002 Byrne
6,716,063 B1 4/2004 Bryant et al.
6,754,511 B1 6/2004 Halford et al.
6,847,653 B1 1/2005 Smiroldo
D501,848 S 2/2005 Uehara et al.
6,853,336 B2 2/2005 Asano et al.
6,864,837 B2 3/2005 Runyon et al.
6,877,277 B2 4/2005 Kussel et al.
6,962,445 B2 11/2005 Zimmel et al.
7,075,492 B1 7/2006 Chen et al.
D533,899 S 12/2006 Ohashi et al.
7,173,570 B1 2/2007 Wensink et al.
7,187,328 B2 3/2007 Tanaka et al.
7,193,562 B2 3/2007 Shtrom et al.
7,212,162 B2 5/2007 Jung et al.
7,212,163 B2 * 5/2007 Huang ..... H01Q 21/24 343/700 MS
7,245,265 B2 7/2007 Kienzle et al.
7,253,783 B2 8/2007 Chiang et al.
7,264,494 B2 9/2007 Kennedy et al.
7,281,856 B2 10/2007 Grzegorzewska et al.
7,292,198 B2 11/2007 Shtrom et al.
7,306,485 B2 12/2007 Masuzaki
7,316,583 B1 1/2008 Mistarz
7,324,057 B2 1/2008 Argaman et al.
D566,698 S 4/2008 Choi et al.
7,362,236 B2 4/2008 Hoiness
7,369,095 B2 * 5/2008 Hirtzlin ..... H01Q 21/067 343/853
7,380,984 B2 6/2008 Wuester
7,431,602 B2 10/2008 Corona
7,436,373 B1 10/2008 Lopes et al.
7,498,896 B2 3/2009 Shi
7,498,996 B2 3/2009 Shtrom et al.
7,507,105 B1 3/2009 Peters et al.
7,522,095 B1 4/2009 Wasiewicz et al.
7,542,717 B2 6/2009 Green, Sr. et al.
7,581,976 B2 9/2009 Liepold et al.
7,586,891 B1 9/2009 Masciulli
7,616,959 B2 11/2009 Spenik et al.
7,646,343 B2 1/2010 Shtrom et al.
7,675,473 B2 3/2010 Kienzle et al.
7,675,474 B2 3/2010 Shtrom et al.
7,726,997 B2 6/2010 Kennedy et al.
7,778,226 B2 8/2010 Rayzman et al.
7,857,523 B2 12/2010 Masuzaki
7,929,914 B2 4/2011 Tegreene
RE42,522 E 7/2011 Zimmel et al.
8,009,646 B2 8/2011 Lastinger et al.
8,069,465 B1 11/2011 Bartholomay et al.
8,111,678 B2 2/2012 Lastinger et al.
8,254,844 B2 8/2012 Kuffner et al.
8,270,383 B2 9/2012 Lastinger et al.
8,275,265 B2 9/2012 Kobyakov et al.
8,325,695 B2 12/2012 Lastinger et al.
D674,787 S 1/2013 Tsuda et al.
8,345,651 B2 1/2013 Lastinger et al.
8,385,305 B1 2/2013 Negus et al.
8,425,260 B2 4/2013 Seefried et al.
8,482,478 B2 7/2013 Hartenstein
8,515,434 B1 8/2013 Narendran et al.
8,515,495 B2 8/2013 Shang et al.
D694,740 S 12/2013 Apostolakis
8,777,660 B2 7/2014 Chiarelli et al.
8,792,759 B2 7/2014 Benton et al.
8,827,729 B2 9/2014 Gunreben et al.
8,836,601 B2 9/2014 Sanford et al.
8,848,389 B2 9/2014 Kawamura et al.
8,870,069 B2 10/2014 Bellows
8,935,122 B2 1/2015 Stisser
9,001,689 B1 4/2015 Hinman et al.
9,019,874 B2 4/2015 Choudhury et al.
9,077,071 B2 7/2015 Shtrom et al.
9,107,134 B1 8/2015 Belser et al.
9,130,305 B2 9/2015 Ramos et al.
9,161,387 B2 10/2015 Fink et al.
9,179,336 B2 11/2015 Fink et al.
9,191,081 B2 11/2015 Hinman et al.
D752,566 S 3/2016 Hinman et al.
9,295,103 B2 3/2016 Fink et al.
9,362,629 B2 6/2016 Hinman et al.
9,391,375 B1 7/2016 Bales et al.
9,407,012 B2 8/2016 Shtrom et al.
9,431,702 B2 8/2016 Hartenstein
9,504,049 B2 11/2016 Hinman et al.
9,531,114 B2 12/2016 Ramos et al.
9,537,204 B2 1/2017 Cheng et al.
9,577,340 B2 2/2017 Fakharzadeh et al.
9,693,388 B2 6/2017 Fink et al.
9,780,892 B2 10/2017 Hinman et al.
9,843,940 B2 12/2017 Hinman et al.
9,871,302 B2 1/2018 Hinman et al.
9,888,485 B2 2/2018 Hinman et al.
9,930,592 B2 3/2018 Hinman
9,949,147 B2 4/2018 Hinman et al.
9,986,565 B2 5/2018 Fink et al.
9,998,246 B2 6/2018 Hinman et al.
10,028,154 B2 7/2018 Elson
10,090,943 B2 10/2018 Hinman et al.
10,096,933 B2 10/2018 Ramos et al.
10,117,114 B2 10/2018 Hinman et al.
10,186,786 B2 1/2019 Hinman et al.
10,200,925 B2 2/2019 Hinman
10,257,722 B2 4/2019 Hinman et al.
10,425,944 B2 9/2019 Fink et al.
10,447,417 B2 10/2019 Hinman et al.

(56) References Cited

U.S. PATENT DOCUMENTS 10,511,074 B2 12/2019 Eberhardt et al.
10,595,253 B2 3/2020 Hinman
10,616,903 B2 4/2020 Hinman et al.
10,714,805 B2 7/2020 Eberhardt et al.
10,742,275 B2 8/2020 Hinman
10,749,263 B2 8/2020 Eberhardt et al.
10,785,608 B2 9/2020 Fink et al.
10,790,613 B2 9/2020 Ramos et al.
10,812,994 B2 10/2020 Hinman et al.
10,863,507 B2 12/2020 Fink et al.
2001/0033600 A1 10/2001 Yang et al.
2002/0102948 A1 8/2002 Stanwood et al.
2002/0159434 A1 10/2002 Gosior et al.
2003/0013452 A1 1/2003 Hunt et al.
2003/0027577 A1 2/2003 Brown et al.
2003/0169763 A1 9/2003 Choi et al.
2003/0222831 A1 12/2003 Dunlap
2003/0224741 A1 12/2003 Sugar et al.
2004/0002357 A1 1/2004 Benveniste
2004/0029549 A1 2/2004 Fikart
2004/0110469 A1 6/2004 Judd et al.
2004/0120277 A1 6/2004 Holur et al.
2004/0155819 A1 8/2004 Martin et al.
2004/0196812 A1 10/2004 Barber
2004/0196813 A1 10/2004 Ofek et al.
2004/0240376 A1 12/2004 Wang et al.
2004/0242274 A1 12/2004 Corbett et al.
2005/0012665 A1 1/2005 Runyon et al.
2005/0032479 A1 2/2005 Miller et al.
2005/0058111 A1 3/2005 Hung et al.
2005/0124294 A1 6/2005 Wentink
2005/0141459 A1* 6/2005 Li ..... H04B 7/0417 370/334
2005/0143014 A1 6/2005 Li et al.
2005/0152323 A1 7/2005 Bonnassieux et al.
2005/0195758 A1 9/2005 Chitrapu
2005/0227625 A1 10/2005 Diener
2005/0254442 A1 11/2005 Proctor, Jr. et al.
2005/0271056 A1 12/2005 Kaneko
2005/0275527 A1 12/2005 Kates
2006/0025072 A1 2/2006 Pan
2006/0072518 A1 4/2006 Pan et al.
2006/0098592 A1 5/2006 Proctor, Jr. et al.
2006/0099940 A1 5/2006 Pfleging et al.
2006/0132359 A1* 6/2006 Chang ..... H01Q 21/065 343/700 MS
2006/0132602 A1 6/2006 Muto et al.
2006/0172578 A1 8/2006 Parsons
2006/0187952 A1 8/2006 Kappes et al.
2006/0211430 A1 9/2006 Persico
2006/0276073 A1 12/2006 McMurray et al.
2007/0001910 A1 1/2007 Yamanaka et al.
2007/0019664 A1 1/2007 Benveniste
2007/0035463 A1* 2/2007 Hirabayashi ..... H01Q 21/24 343/824
2007/0060158 A1 3/2007 Medepalli et al.
2007/0132643 A1 6/2007 Durham et al.
2007/0173199 A1 7/2007 Sinha
2007/0173260 A1 7/2007 Love et al.
2007/0202809 A1 8/2007 Lastinger et al.
2007/0210974 A1 9/2007 Chiang
2007/0223701 A1 9/2007 Emeott et al.
2007/0238482 A1 10/2007 Rayzman et al.
2007/0255797 A1 11/2007 Dunn et al.
2007/0268848 A1 11/2007 Khandekar et al.
2008/0109051 A1 5/2008 Splinter et al.
2008/0112380 A1 5/2008 Fischer
2008/0192707 A1 8/2008 Xhafa et al.
2008/0218418 A1 9/2008 Gillette
2008/0231541 A1* 9/2008 Teshirogi ..... H01Q 1/3233 343/895
2008/0242342 A1 10/2008 Rofougaran
2009/0046673 A1 2/2009 Kaidar
2009/0051597 A1* 2/2009 Wen ..... H01Q 1/243 343/700 MS
2009/0052362 A1 2/2009 Meier et al.
2009/0059794 A1 3/2009 Frei
2009/0075606 A1 3/2009 Shtrom et al.
2009/0096699 A1 4/2009 Chiu et al.
2009/0232026 A1 9/2009 Lu
2009/0233475 A1 9/2009 Mildon et al.
2009/0291690 A1 11/2009 Guvenc et al.
2009/0315792 A1* 12/2009 Miyashita ..... H01Q 21/24 343/742
2010/0029282 A1 2/2010 Stamoulis et al.
2010/0034191 A1 2/2010 Schulz
2010/0039340 A1 2/2010 Brown
2010/0046650 A1 2/2010 Jongren et al.
2010/0067505 A1 3/2010 Fein et al.
2010/0085950 A1 4/2010 Sekiya et al.
2010/0091818 A1 4/2010 Sen et al.
2010/0103065 A1 4/2010 Shtrom et al.
2010/0103066 A1 4/2010 Shtrom et al.
2010/0119002 A1 5/2010 Hartenstein
2010/0136978 A1 6/2010 Cho et al.
2010/0151877 A1 6/2010 Lee et al.
2010/0167719 A1 7/2010 Sun
2010/0171665 A1* 7/2010 Nogami ..... H01Q 21/24 343/700 MS
2010/0171675 A1 7/2010 Borja et al.
2010/0177660 A1 7/2010 Essinger et al.
2010/0189005 A1 7/2010 Bertani et al.
2010/0202613 A1 8/2010 Ray et al.
2010/0210147 A1 8/2010 Hauser
2010/0216412 A1* 8/2010 Rofougaran ..... H04B 1/0003 455/78
2010/0225529 A1 9/2010 Landreth et al.
2010/0238083 A1 9/2010 Malasani
2010/0304680 A1 12/2010 Kuffner et al.
2010/0311321 A1 12/2010 Norin
2010/0315307 A1 12/2010 Syed et al.
2010/0322219 A1 12/2010 Fischer et al.
2011/0006956 A1 1/2011 McCown
2011/0028097 A1 2/2011 Memik et al.
2011/0032159 A1* 2/2011 Wu ..... H01Q 21/24 343/702
2011/0044186 A1 2/2011 Jung et al.
2011/0090129 A1* 4/2011 Weily ..... H01Q 21/24 343/770
2011/0103309 A1 5/2011 Wang et al.
2011/0111715 A1 5/2011 Buer et al.
2011/0112717 A1 5/2011 Resner
2011/0133996 A1 6/2011 Alapuranen
2011/0170424 A1 7/2011 Safavi
2011/0172916 A1 7/2011 Pakzad et al.
2011/0182260 A1 7/2011 Sivakumar et al.
2011/0182277 A1 7/2011 Shapira
2011/0194644 A1 8/2011 Liu et al.
2011/0206012 A1 8/2011 Youn et al.
2011/0241969 A1* 10/2011 Zhang ..... H01Q 21/24 343/853
2011/0243291 A1 10/2011 McAllister et al.
2011/0256874 A1 10/2011 Hayama et al.
2011/0291914 A1 12/2011 Lewry et al.
2012/0008542 A1 1/2012 Koleszar et al.
2012/0040700 A1 2/2012 Gomes et al.
2012/0057533 A1 3/2012 Junell et al.
2012/0093091 A1 4/2012 Kang et al.
2012/0115487 A1 5/2012 Josso
2012/0134280 A1 5/2012 Rotvold et al.
2012/0139786 A1* 6/2012 Puzella ..... H01Q 3/46 342/368
2012/0140651 A1 6/2012 Nicoara et al.
2012/0200449 A1 8/2012 Bielas
2012/0238201 A1 9/2012 Du et al.
2012/0263145 A1 10/2012 Marinier et al.
2012/0282868 A1 11/2012 Hahn
2012/0299789 A1* 11/2012 Orban ..... H01Q 21/24 343/770
2012/0314634 A1 12/2012 Sekhar
2013/0003645 A1 1/2013 Shapira et al.

(56) References Cited

U.S. PATENT DOCUMENTS

2013/0005350 A1 1/2013 Campos et al.
2013/0023216 A1 1/2013 Moscibroda et al.
2013/0044028 A1 2/2013 Lea et al.
2013/0064161 A1 3/2013 Hedayat et al.
2013/0082899 A1 4/2013 Gomi
2013/0095747 A1 4/2013 Moshfeghi
2013/0128858 A1 5/2013 Zou et al.
2013/0176902 A1 7/2013 Wentink et al.
2013/0182652 A1 7/2013 Tong et al.
2013/0195081 A1 8/2013 Merlin et al.
2013/0210457 A1 8/2013 Kummetz
2013/0223398 A1 8/2013 Li
2013/0234898 A1 9/2013 Leung et al.
2013/0271319 A1 10/2013 Trerise
2013/0286950 A1 10/2013 Pu
2013/0286959 A1 10/2013 Lou et al.
2013/0288735 A1 10/2013 Guo
2013/0301438 A1 11/2013 Li et al.
2013/0322276 A1 12/2013 Pelletier et al.
2013/0322413 A1 12/2013 Pelletier et al.
2014/0024328 A1 1/2014 Balbien et al.
2014/0051357 A1 2/2014 Steer et al.
2014/0098748 A1 4/2014 Chan et al.
2014/0113676 A1 4/2014 Hamalainen et al.
2014/0145890 A1 5/2014 Ramberg et al.
2014/0154895 A1 6/2014 Poulsen et al.
2014/0185494 A1 7/2014 Yang et al.
2014/0191918 A1 7/2014 Cheng et al.
2014/0198867 A1 7/2014 Sturkovich et al.
2014/0206322 A1 7/2014 Dimou et al.
2014/0225788 A1 8/2014 Schulz et al.
2014/0233613 A1 8/2014 Fink et al.
2014/0235244 A1 8/2014 Hinman
2014/0240186 A1* 8/2014 Zhou ..... H01Q 21/205 343/772
2014/0253378 A1 9/2014 Hinman
2014/0253402 A1 9/2014 Hinman et al.
2014/0254700 A1 9/2014 Hinman et al.
2014/0256166 A1 9/2014 Ramos et al.
2014/0320306 A1 10/2014 Winter
2014/0320377 A1 10/2014 Cheng et al.
2014/0328238 A1 11/2014 Seok et al.
2014/0341013 A1 11/2014 Kumar
2014/0355578 A1 12/2014 Fink et al.
2014/0355584 A1 12/2014 Fink et al.
2015/0002354 A1 1/2015 Knowles
2015/0015435 A1 1/2015 Shen et al.
2015/0116177 A1 4/2015 Powell et al.
2015/0156642 A1 6/2015 Sobczak et al.
2015/0215952 A1 7/2015 Hinman et al.
2015/0256213 A1 9/2015 Jan et al.
2015/0256275 A1 9/2015 Hinman et al.
2015/0263816 A1 9/2015 Hinman et al.
2015/0319584 A1 11/2015 Fink et al.
2015/0321017 A1 11/2015 Perryman et al.
2015/0325945 A1 11/2015 Ramos et al.
2015/0327272 A1 11/2015 Fink et al.
2015/0365866 A1 12/2015 Hinman et al.
2016/0119018 A1 4/2016 Lindgren et al.
2016/0149634 A1 5/2016 Kalkunte et al.
2016/0149635 A1 5/2016 Hinman et al.
2016/0211583 A1 7/2016 Lee et al.
2016/0338076 A1 11/2016 Hinman et al.
2016/0365666 A1 12/2016 Ramos et al.
2016/0366601 A1 12/2016 Hinman et al.
2017/0048647 A1 2/2017 Jung et al.
2017/0201028 A1 7/2017 Eberhardt et al.
2017/0238151 A1 8/2017 Fink et al.
2017/0294975 A1 10/2017 Hinman et al.
2017/0353245 A1 12/2017 Vardarajan et al.
2018/0034166 A1 2/2018 Hinman
2018/0035317 A1 2/2018 Hinman et al.
2018/0083365 A1 3/2018 Hinman et al.
2018/0084563 A1 3/2018 Hinman et al.
2018/0160353 A1 6/2018 Hinman
2018/0167105 A1 6/2018 Vannucci et al.
2018/0192305 A1 7/2018 Hinman et al.
2018/0199345 A1 7/2018 Fink et al.
2018/0241491 A1 8/2018 Hinman et al.
2019/0006789 A1 1/2019 Ramos et al.
2019/0182686 A1 6/2019 Hinman et al.
2019/0214699 A1 7/2019 Eberhardt et al.
2019/0215745 A1 7/2019 Hinman
2019/0273326 A1 9/2019 Sanford et al.
2020/0015231 A1 1/2020 Fink et al.
2020/0036465 A1 1/2020 Hinman et al.
2020/0067164 A1 2/2020 Eberhardt et al.
2020/0083614 A1 3/2020 Sanford et al.

FOREIGN PATENT DOCUMENTS

CN 105191204 12/2015
CN 105191204 B 5/2019
EP 1384285 B1 6/2007
EP 002640177 2/2015
WO WO2014137370 9/2014
WO WO2014138292 9/2014
WO WO2014193394 12/2014
WO WO2015112627 7/2015
WO WO2017123558 A1 7/2017
WO WO2018022526 A1 2/2018
WO WO2019136257 A1 7/2019
WO WO2019168800 A1 9/2019

OTHER PUBLICATIONS

L. Liu et al., Downlink MIMO in LTE-Advanced: SU-MIMO vs. MU-MIMO, IEEE Communications Magazine, Feb. 2012.*
T. Teshirogi et al., Wideband Circularly Polarized Array Antenna with Sequential Rotations and Phase Shift of Elements, Proceedings of the International Symposium on Antennas and Propagation, p. 117-120, 1985 (Year: 1985).*
R.L. Haupt, Antenna Arrays: A Computational Approach, chapter 5: Nonplaner Arrays, Wiley-IEEE Press, 2010 (Year: 2010).*
Advisory Action, dated Jul. 31, 2014, U.S. Appl. No. 13/906,128, filed May 30, 2013.
Non-Final Office Action, dated Aug. 25, 2014, U.S. Appl. No. 13/906,128, filed May 30, 2013.
Non-Final Office Action, dated Sep. 22, 2014, U.S. Appl. No. 14/045,741, filed Oct. 3, 2013.
Non-Final Office Action, dated Jan. 5, 2015, U.S. Appl. No. 14/183,445, filed Feb. 18, 2014.
Non-Final Office Action, dated Jan. 15, 2015, U.S. Appl. No. 14/183,329, filed Feb. 18, 2014.
Non-Final Office Action, dated Jan. 2, 2015, U.S. Appl. No. 13/925,566, filed Jun. 24, 2013.
Notice of Allowance, dated Dec. 30, 2014, U.S. Appl. No. 14/164,081, filed Jan. 24, 2014.
Non-Final Office Action, dated Mar. 18, 2015, U.S. Appl. No. 14/183,375, filed Feb. 18, 2014.
Final Office Action, dated Mar. 23, 2015, U.S. Appl. No. 13/906,128, filed May 30, 2013.
Notice of Allowance, dated Jun. 3, 2015, U.S. Appl. No. 14/045,741, filed Oct. 3, 2013.
Notice of Allowance, dated Jul. 13, 2015, U.S. Appl. No. 14/183,445, filed Feb. 18, 2014.
Notice of Allowance, dated Jul. 15, 2015, U.S. Appl. No. 13/925,566, filed Jun. 24, 2013.
Notice of Allowance dated Sep. 8, 2015 in Chinese Design Patent Application 201530058063.8, filed Mar. 11, 2015.
Notice of Allowance, dated Aug. 19, 2015, U.S. Appl. No. 14/183,329, filed Feb. 18, 2014.
Final Office Action, dated Nov. 24, 2015, U.S. Appl. No. 14/183,375, filed Feb. 18, 2014.
Notice of Allowance, dated Oct. 26, 2015, U.S. Appl. No. 13/906,128, filed May 30, 2013.
Non-Final Office Action, dated Sep. 10, 2015, U.S. Appl. No. 14/198,378, filed Mar. 5, 2014.

(56) References Cited

OTHER PUBLICATIONS

Advisory Action, dated Mar. 2, 2016, U.S. Appl. No. 14/183,375, filed Feb. 18, 2014.
Non-Final Office Action, dated Mar. 16, 2016, U.S. Appl. No. 14/325,307, filed Jul. 7, 2014.
Notice of Allowance, dated Apr. 6, 2016, U.S. Appl. No. 14/198,378, filed Mar. 5, 2014.
Non-Final Office Action, dated Apr. 7, 2016, U.S. Appl. No. 14/639,976, filed Mar. 5, 2015.
Non-Final Office Action, dated Apr. 26, 2016, U.S. Appl. No. 14/802,829, filed Jul. 17, 2015.
Notice of Allowance, dated Jul. 26, 2016, U.S. Appl. No. 14/325,307, filed Jul. 7, 2014.
Notice of Allowance, dated Aug. 16, 2016, U.S. Appl. No. 14/802,829, filed Jul. 17, 2015.
Non-Final Office Action, dated Sep. 15, 2016, U.S. Appl. No. 14/183,375, filed Feb. 18, 2014.
Non-Final Office Action, dated Sep. 30, 2016, U.S. Appl. No. 14/657,942, filed Mar. 13, 2015.
Final Office Action, dated Oct. 12, 2016, U.S. Appl. No. 14/741,423, filed Jun. 16, 2015.
Final Office Action, dated Oct. 17, 2016, U.S. Appl. No. 14/639,976, filed Mar. 5, 2015.
Non-Final Office Action, dated Oct. 26, 2016, U.S. Appl. No. 15/139,225, filed Apr. 26, 2016.
Advisory Action, dated Jan. 19, 2017, U.S. Appl. No. 14/639,976, filed Mar. 5, 2015.
Non-Final Office Action, dated Jan. 27, 2017, U.S. Appl. No. 14/198,473, filed Mar. 5, 2014.
Non-Final Office Action, dated Feb. 17, 2017, U.S. Appl. No. 14/833,038, filed Aug. 21, 2015.
Non-Final Office Action, dated Feb. 23, 2017, U.S. Appl. No. 15/246,094, filed Aug. 24, 2016.
Notice of Allowance, dated Mar. 1, 2017, U.S. Appl. No. 14/741,423, filed Jun. 16, 2015.
Non-Final Office Action, dated Dec. 24, 2013, U.S. Appl. No. 14/045,741, filed Oct. 3, 2013.
Non-Final Office Action, dated Dec. 11, 2013, U.S. Appl. No. 13/906,128, filed May 30, 2013.
Final Office Action, dated Apr. 15, 2014, U.S. Appl. No. 13/906,128, filed May 30, 2013.
Non-Final Office Action, dated Jun. 16, 2014, U.S. Appl. No. 14/164,081, filed Jan. 24, 2014.
Final Office Action, dated Apr. 16, 2014, U.S. Appl. No. 14/045,741, filed Oct. 3, 2013.
International Search Report and Written Opinion of the International Search Authority dated Nov. 26, 2013 in Patent Cooperation Treaty Application No. PCT/US2013/047406, filed Jun. 24, 2013.
International Search Report and Written Opinion of the International Search Authority dated Aug. 9, 2013 in Patent Cooperation Treaty Application No. PCT/US2013/043436, filed May 30, 2013.
International Search Report and Written Opinion of the International Search Authority dated Jul. 1, 2014 in Patent Cooperation Treaty Application No. PCT/US2014/020880, filed Mar. 5, 2014.
Non-Final Office Action, dated Mar. 22, 2017, U.S. Appl. No. 15/224,412, filed Jul. 29, 2016.
Non-Final Office Action, dated Mar. 30, 2017, U.S. Appl. No. 15/246,118, filed Aug. 24, 2016.
Notice of Allowance, dated Apr. 10, 2017, U.S. Appl. No. 14/639,976, filed Mar. 5, 2015.
Final Offfice Action, dated Apr. 13, 2017, U.S. Appl. No. 15/139,225, filed Apr. 26, 2016.
Final Office Action, dated May 11, 2017, U.S. Appl. No. 14/183,375, filed Feb. 18, 2014.
Non-Final Office Action, dated Jun. 7, 2017, U.S. Appl. No. 14/802,816, filed Jul. 17, 2015.
Final Office Action, dated Jun. 22, 2017, U.S. Appl. No. 14/657,942, filed Mar. 13, 2015.
Non-Final Office Action, dated Jul. 5, 2017, U.S. Appl. No. 14/848,202, filed Sep. 8, 2015.
Notice of Allowance, dated Jul. 31, 2017, U.S. Appl. No. 14/833,038, filed Aug. 21, 2015.
International Search Report and "Written Opinion of the International Searching Authority," Patent Cooperation Treaty Application No. PCT/US2017/012884, dated Apr. 6, 2017, 9 pages.
International Search Report and Written Opinion of the International Search Authority dated Jun. 29, 2015 in Patent Cooperation Treaty Application No. PCT/US2015/012285, filed Jan. 21, 2015.
Hinman et al., U.S. Appl. No. 61/774,532, filed Mar. 7, 2013.
First Official Notification dated Jun. 15, 2015 in Chinese Design Patent Application 201530058063.8, filed Mar. 11, 2015.
"Office Action," Chinese Patent Application No. 201580000078.6, dated Nov. 3, 2017, 5 pages [10 pages including translation].
"International Search Report" and "Written Opinion of the International Searching Authority," Patent Cooperation Treaty Application No. PCT/US2017/043560, dated Nov. 16, 2017, 11 pages.
"Notice of Allowance," Chinese Patent Application No. 201580000078.6, dated Feb. 11, 2019, 2 pages.
"International Search Report" and "Written Opinion of the International Search Authority," dated Mar. 22, 2019 in Patent Cooperation Treaty Application No. PCT/US2019/012358, filed Jan. 4, 2019, 9 pages.
FCC Regulations, 47 CFR § 15.407, 63 FR 40836, Jul. 31, 1998, as amended at 69 FR 2687, Jan. 20, 2004; 69 FR 54036, Sep. 7, 2004; pp. 843-846.
"International Search Report" and "Written Opinion of the International Search Authority," dated May 23, 2019 in Patent Cooperation Treaty Application No. PCT/US2019/019462, filed Feb. 25, 2019, 8 pages.
"Sector Antennas," Radiowaves.com, [online], [retrieved Oct. 10, 2019], Retrieved from the Internet: <URL:https://www.radiowaves.com/en/products/sector-antennas>, 4 pages.
KP Performance Antennas Search Results for Antennas, Sector, Single, [online], KPPerformance.com [retrieved Oct. 10, 2019], Retrieved from the Internet: <URL:https://www.kpperformance.com/search?Category=Antennas&Rfpsan99design=Sector&Rfpsan99option=Single&view_type=grid>, 6 pages.
"Partial Supplemental European Search Report," European Patent Application No. 17835073.2, Feb. 13, 2020, 17 pages.
"Wireless Access Point," Wikipedia.org, Jan. 6, 2020 [retrieved on Feb. 3, 2020], Retrieved from the Internet: <https://en.wikipedia.org/wiki/Wireless_access_point>, 5 pages.
"Extended European Search Report", European Patent Application No. 17835073.2, dated Jun. 30, 2020, 15 pages.
Dowla, Farid et al., "RF and Wireless Technologies: Know It All", Netherlands, Elsevier Science, 2008, p. 314.

* cited by examiner

ELLIPTICITY REDUCTION IN CIRCULARLY POLARIZED ARRAY ANTENNAS

CROSS REFERENCE TO RELATED APPLICATIONS

This application claims the priority benefit of U.S. Provisional Application Ser. No. 61/841,187, filed on Jun. 28, 2013, titled "ELLIPTICITY REDUCTION IN CIRCULARLY POLARIZED ARRAY ANTENNAS", which is hereby incorporated herein by reference, including all references cited therein.

FIELD OF THE INVENTION

The present technology generally relates to circularly polarized antennas, and more specifically, but not by way of limitation, to an exemplary antenna having an array of circularly polarized elements that are clocked that the output of the antenna has a minimal ellipticity (e.g., eccentricity), resulting in a more purified circular polarization of the antenna.

BACKGROUND

Circular polarization occurs when elements of an antenna produce an electromagnetic wave (e.g., generated field) that varies rotationally in a direction of propagation. More specifically, circular polarization is comprised of two orthongal and equal magnitude linear polarized waves which are 90 degrees out of phase relative to one another. In most cases, the circular behavior of the electromagnetic wave appears more elliptical than circular, producing what is known as elliptical polarization. In fact, circular polarization and linear polarization are often considered special cases of elliptical polarization. In general, elliptical polarization is defined by an eccentricity, which is a ratio of the major and minor axis amplitudes of the horizontal and vertical waves. That is, circular polarization of an electromagnetic wave can be broken down into both horizontal and vertical components. The eccentricity is introduced when the horizontal and vertical components of the fields are not purely orthogonal to one another, equal, or when the phase shift is other than 90 degrees.

It will be understood that an elliptically polarized wave having an eccentricity of approximately one (1) is what is referred to as a pure circularly polarized wave. In contrast, as the eccentricity of the elliptically polarized wave increases, the wave begins to look more like linear polarization.

SUMMARY

According to some embodiments, the present technology is directed to an antenna array, comprising: (a) a plurality of elements, each of the plurality of elements producing an elliptically polarized wave having an eccentricity value (other than one), the elliptically polarized wave traveling along a direction of propagation, wherein at least a portion of the plurality of elements are incrementally clocked around their direction of propagation, so that a combined output of the plurality of elements is substantially circularly polarized.

According to some embodiments, the present technology is directed to method, comprising: (a) controlling each of a plurality of elements, wherein each of the plurality of elements produce an elliptically polarized wave having an eccentricity value other than one, the elliptically polarized wave traveling along a direction of propagation, wherein at least a portion of the plurality of elements are incrementally clocked around their direction of propagation, so that a combined output of the plurality of elements is substantially circularly polarized.

According to some embodiments, the present technology is directed to a wireless device, comprising an antenna array, the antenna array comprising a plurality of elements, each of the plurality of elements producing an elliptically polarized wave having a polarization vector that is perpendicular to a major axis of the elliptically polarized wave, at least a portion of the plurality of elements being incrementally clocked relative to one another such that an ellipticity of a combined output of the antenna array is reduced.

According to some embodiments, the present technology is directed to an antenna array, comprising: (a) a processor; and (b) a memory for storing executable instructions, the processor executing the instructions stored in memory to: (i) control a plurality of elements, each of the plurality of elements producing an elliptically polarized wave having an eccentricity value, the elliptically polarized wave traveling along a direction of propagation, wherein at least a portion of the plurality of elements are incrementally clocked around their direction of propagation, so that a combined output of the plurality of elements is substantially circularly polarized, wherein each of the plurality of elements: (1) is associated with a feed; and (2) comprises a compensating line length in the feed that compensates for a phase shift present in the combined output, caused by clocking of the plurality of elements.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive may be omitted. It will be understood that the technology is not necessarily limited to the particular embodiments illustrated herein.

DESCRIPTION OF EXEMPLARY EMBODIMENTS

Figure 1A:
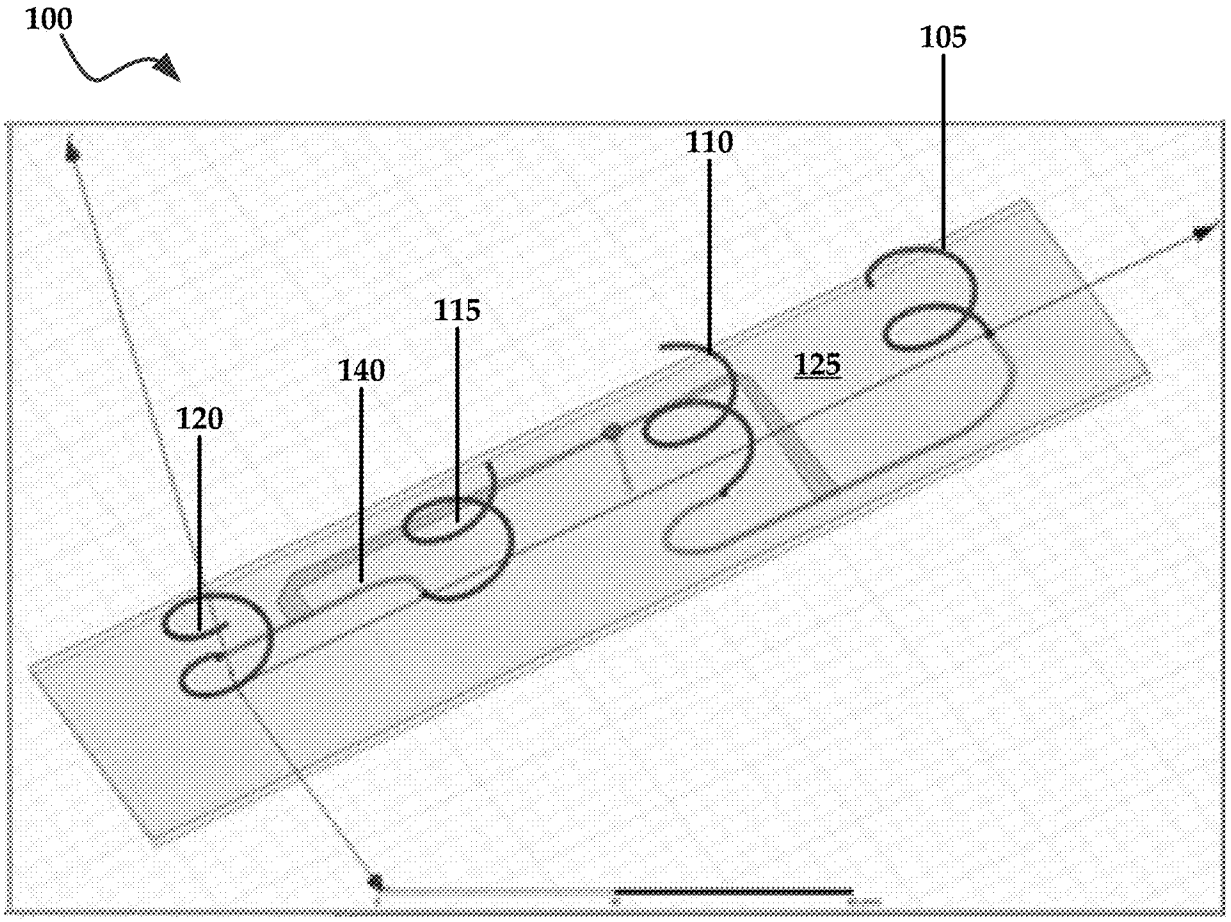
FIG. 1A is a schematic diagram of an exemplary a linear antenna having an array of elliptically polarized elements, constructed in accordance with the present technology.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

It will be understood that like or analogous elements and/or components, referred to herein, may be identified throughout the drawings with like reference characters. It will be further understood that several of the figures are merely schematic representations of the present technology. As such, some of the components may have been distorted from their actual scale for pictorial clarity.

The terminology used herein is for the purpose of describing particular embodiments only and is not intended to be limiting of the technology. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that like or analogous elements and/or components, referred to herein, may be identified throughout the drawings with like reference characters. It will be further understood that several of the figures are merely schematic representations of the present technology. As such, some of the components may have been distorted from their actual scale for pictorial clarity.

Array antennas using elliptically polarized elements often exhibit polarization ellipticity significantly greater than desired. Indeed, most antenna elements produce waves that are slightly, if not more, elliptical than purely circular. As mentioned above, circular and linear polarization are often considered as special cases of elliptical polarization. Ellipticity in radiation produced by polarized antennas may cause deleterious effects such as polarization mismatch, loss, or compromised isolation. For example, when two antennas (each with an array of polarized antennas) are transmitting to one another and the radiated fields produced by array elements of either one of the antennas are more elliptical (trending to linear polarization) rather than purely circular, the radiated fields may interfere with one another.

Often times, manufacturers struggling to remedy ellipticity of antennas may attempt to produce circularly polarized elements that individually produce very low and often impractical levels of ellipticity, when the ultimate desire is to achieve circular polarization for an output of the antenna as a whole. That is, trying to cure the eccentricity behavior of the antenna by purifying the radiated fields with individual circularly polarized elements is costly and often impractical.

An antenna array is typically fabricated from identical polarized elements distributed on a substrate or within a dielectric material. For an antenna array intended to produce circular polarization, each element exhibits some degree of elliptical polarization, compromising the resulting array polarization.

Rather than attempting to minimize ellipticity and maximize the circular polarization of an antenna by changing the behavior of individual array elements, the present technology provides an array of elliptically polarized elements where each elliptically polarized element is physically rotated (clocked) relative to the other polarized elements in the array. Each of the polarized elements produces an elliptically polarized wave that travels along a direction of propagation. This direction of propagation is substantially oriented to a central axis of the polarized element. Additionally, the direction of propagation is perpendicular to the primary polarization axis of the elliptical wave (electric field direction) produced by the element.

At least a portion of the plurality of elements are incrementally clocked around their direction of propagation roll axes so that a combined output of the plurality of elements is substantially circularly polarized. In some embodiments, all adjacent elements of an antenna array are clocked relative to one another. In other embodiments, some polarized elements of an antenna array are clocked identically to one another such that only a portion of the polarized elements are clocked.

Thus, a plurality of elements that each produces a wave that is elliptical in nature may be arranged in such a way that the aggregate behavior of these circularly polarized elements performs as circular polarization. That is, the combined output of the clocked plurality of elements is substantially circularly polarized.

Typically, the distribution of these elliptically polarized elements in an exemplary antenna is uniform or consistent through 360 degrees. The physical rotation (roll axis) of elements is referred to as "clocking" of elements. In some instances the clocking or angular offset between elements is calculated by determining a total number of elements and dividing 360 degrees by the total number of circularly polarized elements.

An angular offset for example, may include a first element that is set to zero degrees, while an adjacent element is clocked to 90 degrees. The angular offset would be 90 degrees.

FIG. 1A illustrates an exemplary array 100 that includes four elements 105-120 that are arranged onto a substrate 125. The elements 105-120 would be clocked at 90 degrees relative to one another. To clock the four elements, a reference element 105 is chosen and assigned a degree of zero. The next element 110 in the array is clocked to 90 degrees, leaving the remaining elements 115 and 120 clocked at 180 and 270 degrees, respectively. An output of the antenna array 100, which includes an aggregated polarization of all the elements averages to a nearly circular polarization. While the example provided above contemplates the use of four elements, it will be understood that any number of elements may be utilized. Thus, the clocking of an N number of elements is calculated as 360/N. In another exemplary embodiment, the antenna may include an array of 12 elements clocked with 120-degree steps. Also, while the elements of the array of FIG. 1A are illustrated being disposed in a linear array configuration, the elements may be arranged in other configurations such as planar, three dimensional object, circular, rectangular, elliptical, offset, alternating, and/or other configurations that would be known to one of ordinary skill in the art. Additionally, while the plurality of elements of the array are illustrated as extending from the same two dimensional surface of the substrate 125, the plurality of elements may also be disposed on a three dimensional surface, such as the array of FIG. 1C. FIG. 1C illustrates an example three dimensional device 150 such as a building or other structure, or even a wireless radio housing. The three dimensional device 150 includes a plurality of antenna arrays 155A-C. The antenna arrays 155A-C may each comprise a plurality of clock elements, similarly to the exemplary array 100 of FIG. 1A. It will be understood that other types of arrays and combinations of array may likewise be utilized in accordance with the present technology.

Returning back to FIG. 1A, as will be discussed in greater detail below, each of the elements may be associated with a feed, such as feed 140 of element 115. The feed 140 may comprise a compensating line length that is used to mitigate, reduce, and/or eliminate a phase shift that created due to the clocking of the elements.

The rotation or clocking of circularly polarized elements introduces a phase shift into the summation network (the combined output of the antenna). The present technology may mitigate or compensate for this phase shift with, for example, an additional compensating line length in the feed) associated with individual elements. This correction maintains the array distribution as if the clocking had not been performed, while reducing array ellipticity to an acceptable level due to the actual clocking. The compensating line length induces a phase correction, which mitigates or reduces the phase shift due to the element clocking.

It will be understood that in addition to selectively adjusting line lengths for each element, the use of discreet components, such as capacitors or inductors, may also be utilized to induce a compensating phase shift. Indeed, many methods or devices for introducing a phase shift compensation, such as a compensating time delay may be utilized. In some instances, the antenna may include logic that is executed by a processor that induces a phase shift compensation by inducing a time delay. These various methods and devices are also referred to collectively and individually as different means for compensating for a phase shift in the combined output, caused by clocking of the plurality of elements.

Also, circularly polarized antennas of the present technology may be advantageously leveraged in instances where signal isolation is desirable. For instance, circularly polarized antennas of the present technology may be used in radios where chain-to-chain isolation is required. By ensuring that you have purity in circular polarization, and you have alternating right and left circularly polarized chains, the purity of these chains at 90 degrees directly translates into isolation of those chains.

While the above description contemplates addressing polarization of elements at a peak of the beam as illustrated in FIG. 1A, the present technology may likewise be applied to address polarization elsewhere, for example, at 90 degrees.

Figure 1B:
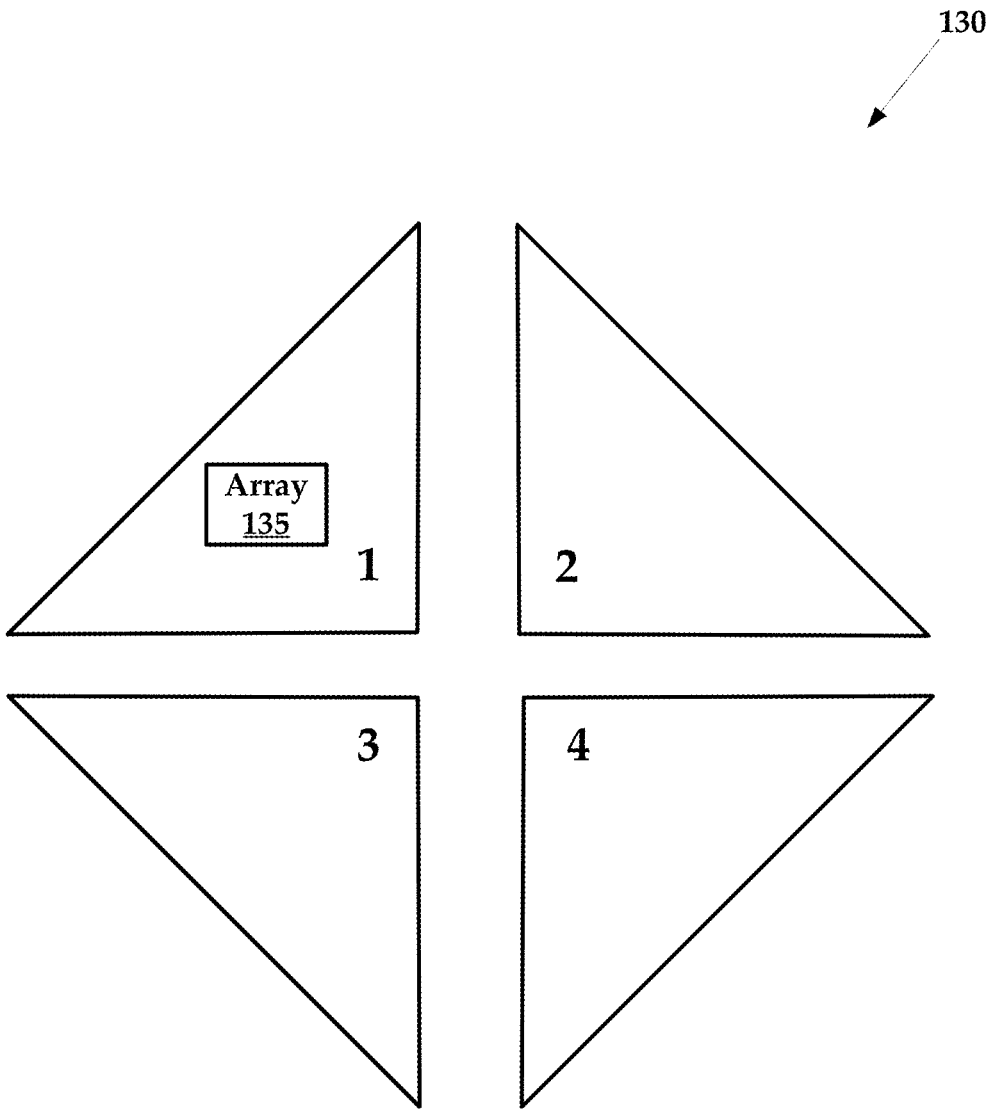
FIG. 1B is a schematic diagram of exemplary system that comprises a plurality of elliptically polarized antennas.
Figure 1C:
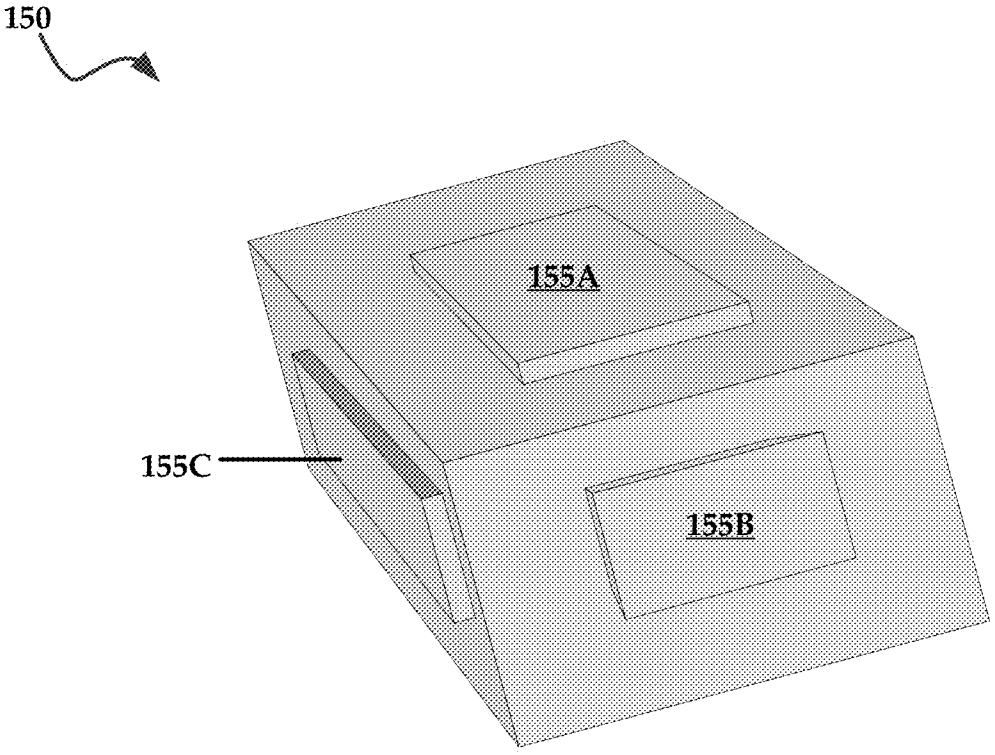
FIG. 1C is a perspective view of a three dimensional device that includes a plurality of antenna arrays of the present technology.

FIG. 1B illustrates an exemplary system 130 that comprises a plurality of circularly polarized antennas 1-4, where each antenna broadcasts in a fixed direction over a coverage area in such a way that signals broadcast by each of the plurality of circularly polarized antennas are isolated to minimize signal overlap. Each of the antennas, such as antenna 1, may include an array 135 of clocked elements.

Figure 1D:
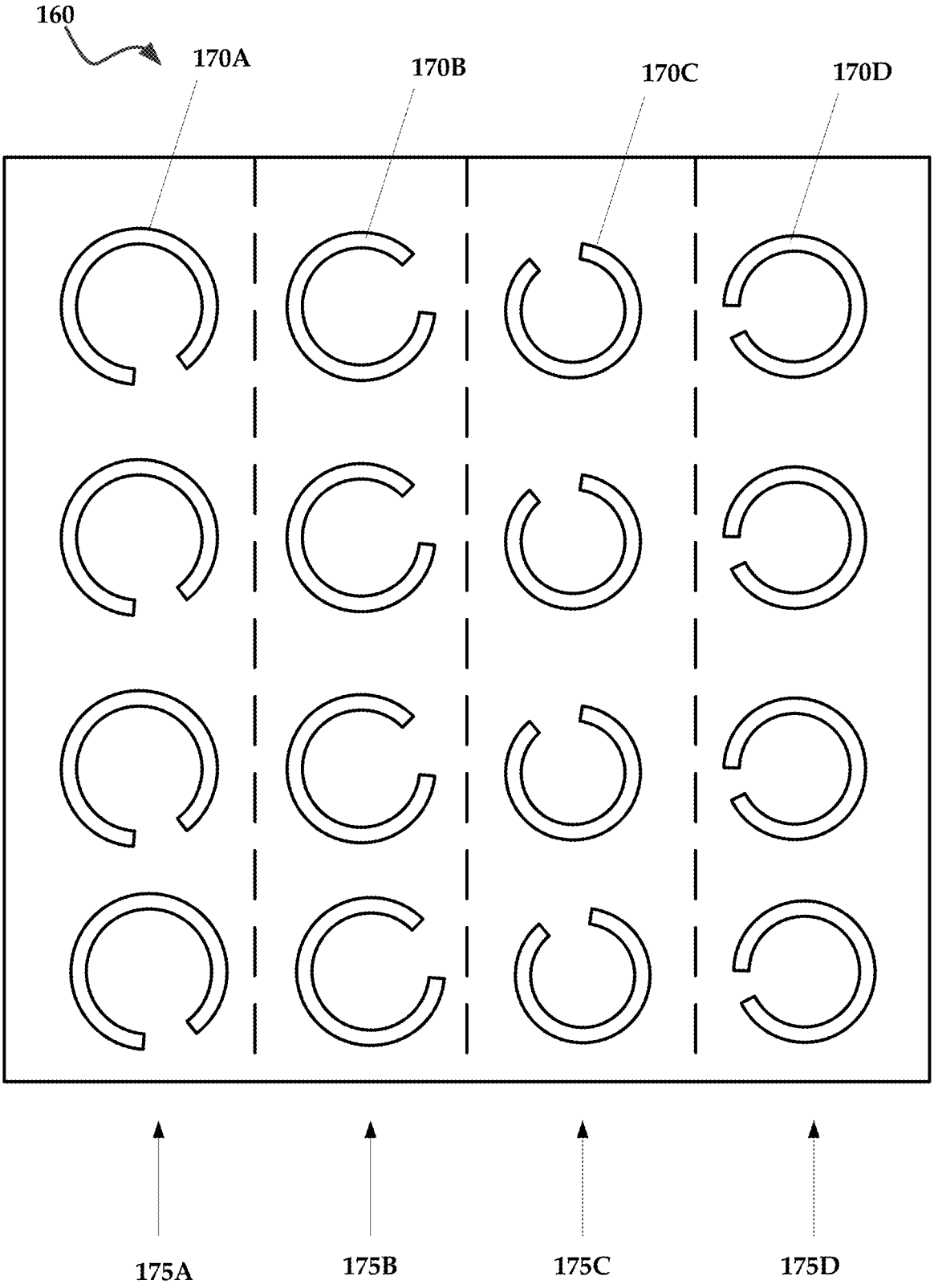
FIG. 1D is a schematic view of a 4×4 antenna array where at least a portion of a plurality of elements are clocked relative to one another.

In order to eliminate the need for explicit client channel state information (CSI) feedback and maintain compatibility with legacy Single User MIMO (SU-MIMO) 802.11 clients, circularly polarized antennas/streams are isolated in unique fixed directions with limited or no radiation overlap. It is noteworthy that in some embodiments, the plurality of circularly polarized antennas are allowed to overlap, such that the signals broadcast by adjacent antennas slightly overlap. Such overlapping of transmissions by antennas are common in devices such as multiple-input-multiple-output (MIMO) wireless devices, and specifically Multi-User MIMO (MU-MIMO) devices. FIG. 1D is another example array 170 that comprises rows and columns of elements. As an example, a first row includes elements 170A-D, where element 170A is the reference element that is set to zero degrees, with each adjacent element (moving left to right) is clocked approximately 90 degrees. In this embodiment, only horizontally adjacent and diagonally adjacent elements are clocked relative to one another. That is, the elements in row 175A are all referenced to zero degrees. Each of the remaining columns 175B-D are likewise comprised of identically clocked elements. Thus, in this embodiment, only a portion of adjacent elements are clocked relative to one another, while some adjacent elements, such as those that are vertically aligned with one another are not clocked relative to one another.

Figure 2:
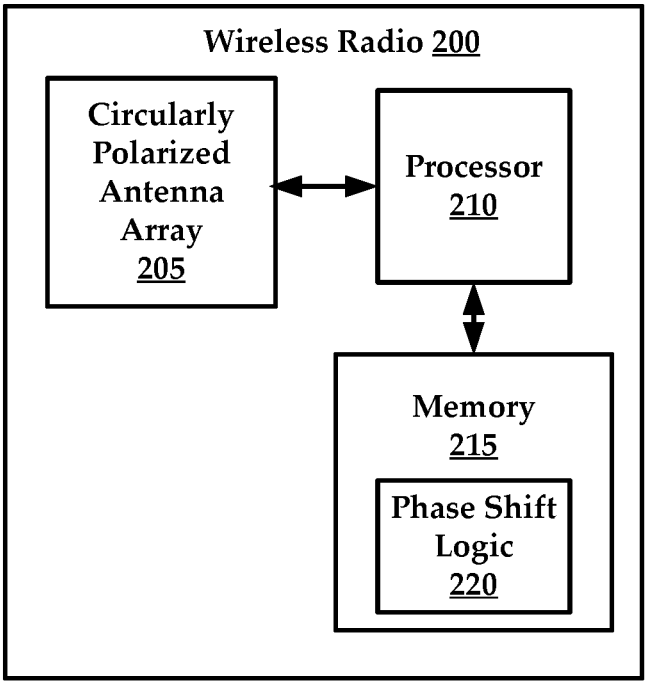
FIG. 2 is a block diagram of an exemplary wireless device, such as a wireless radio that incorporates a circularly polarized antenna array, such as the array of FIG. 1A.

FIG. 2 is a block diagram of an exemplary wireless device, such as a wireless radio 200 that incorporates a circularly polarized antenna array 205, such as the array of FIG. 1A. The circularly polarized antenna array 205 is controlled by a processor 210. The wireless device 200 also comprises a memory 215 for storing executable instructions that are executable by the processor 210 to control the circularly polarized antenna array 205, such as causing the elements of the array to transmit and/or receive signals. As mentioned above, the clocking of the elements in the circularly polarized antenna array 205 may induce a phase shift in the combined output of the circularly polarized antenna array 205. In some embodiments, phase shift logic 220 is stored in the memory 215 and is executed by the processor 210 to mitigate, reduce, and/or eliminate the phase shift to an acceptable level.

Figure 3:
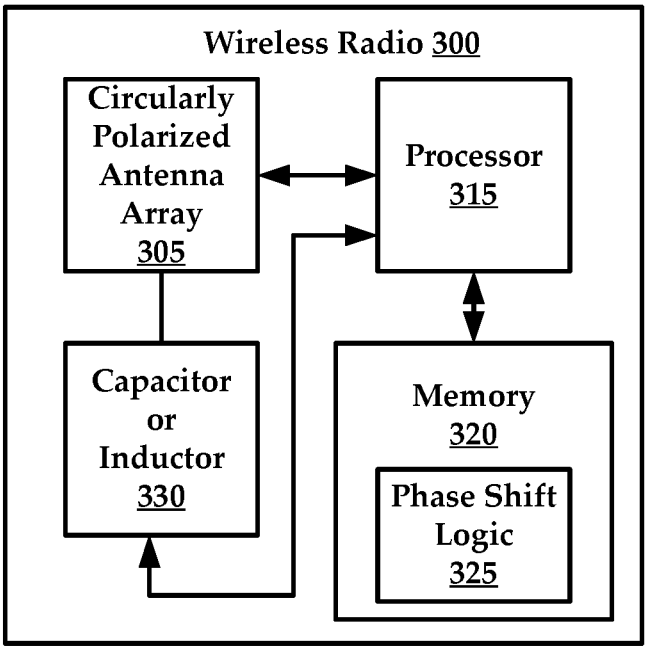
FIG. 3 is a block diagram of another exemplary wireless device, such as a wireless radio that incorporates a circularly polarized antenna array, such as the array of FIG. 1A.

FIG. 3 is a block diagram of another exemplary wireless device, such as a wireless radio 300 that incorporates a circularly polarized antenna array 305, such as the array of FIG. 1A. This device is constructed similarly to the device of FIG. 2, with the exception that the wireless device 300 includes a capacitor and/or inductor 330 that are configured to mitigate, reduce, and/or eliminate the phase shift in the combined output of the circularly polarized antenna array 305. More specifically, the processor 315 may control the capacitor and/or inductor 330 in such a way that an output of the capacitor and/or inductor 330 causes a mitigation, reduction, and/or elimination of the phase shift. It will be understood that the processor 315 may use a combination of capacitor and/or inductor 330 functions as well as execution of phase shift logic 325, stored in the memory 320, to compensate for the phase shift in the combined output of the circularly polarized antenna array 305.

Figure 4:
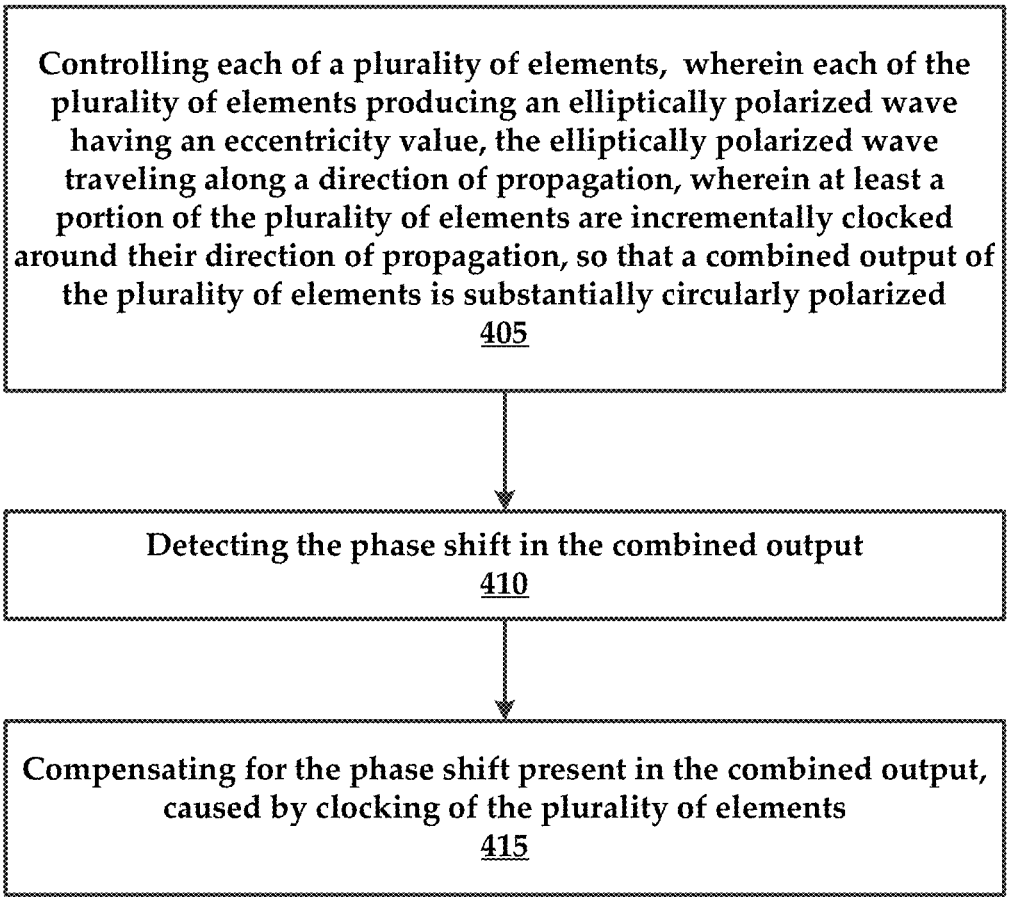
FIG. 4 is a method for reducing ellipticity in circularly polarized antenna arrays.

FIG. 4 is a flowchart of an exemplary method executed by, for example, the wireless radio/device of FIG. 2. The method may comprise controlling 405 each of a plurality of elements. As mentioned above, each of the plurality of elements produce an elliptically polarized wave having an eccentricity value. The plurality of elements are incrementally clocked relative to one another such that a primary polarization axis of each element is pointed in a unique direction. In detail, a combined output of the plurality of elements is substantially circularly polarized due to the clocking of the elements.

Next, the method comprises detecting 410 a phase shift in the combined output of the array. Again, the physical clocking of the elements of the array may induce a phase shift that causes interference in the signals transmitted and/or receive by the wireless device. Mitigation, reduction, or elimination of this phase shift will reduce this noise/interference.

If a phase shift is detected, the method comprises compensating 415 for a phase shift present in the combined output, caused by clocking of the plurality of elements.

Figure 5:
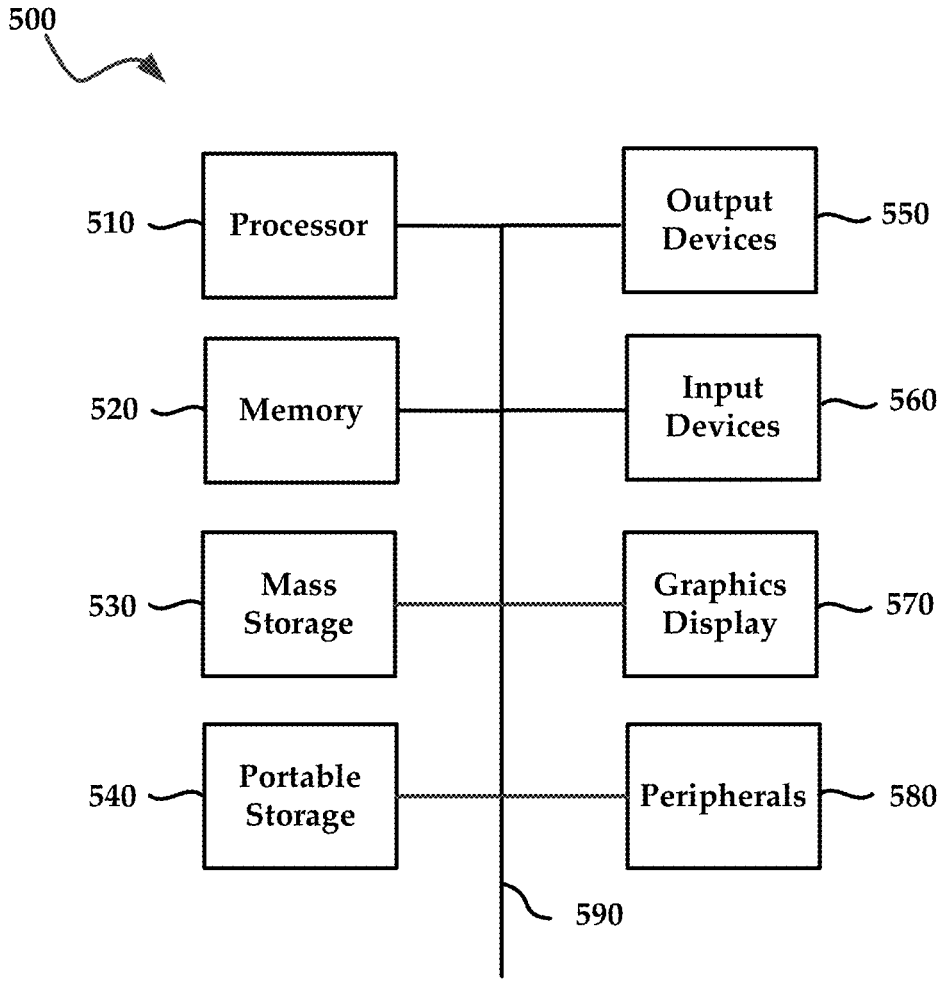
FIG. 5 illustrates an exemplary computing system that may be used to implement embodiments according to the present technology.

FIG. 5 illustrates an exemplary computing device 500 that may be used to implement an embodiment of the present systems and methods. The system 500 of FIG. 5 may be implemented in the contexts of the likes of computing devices, networks, servers, or combinations thereof. The computing device 500 of FIG. 5 includes a processor 510 and memory 520. Memory 520 stores, in part, instructions and data for execution by processor 510. Memory 520 may store the executable code when in operation. The system 500 of FIG. 5 further includes a mass storage device 530, portable storage device 540, output devices 550, input devices 560, a graphics display 570, and peripheral devices 580. The components shown in FIG. 5 are depicted as being connected via a single bus 590. The components may be connected through one or more data transport means. Processor 510 and memory 520 may be connected via a local microprocessor bus, and the mass storage device 530, peripheral device(s) 580, portable storage device 540, and graphics display 570 may be connected via one or more input/output (I/O) buses.

Mass storage device 530, which may be implemented with a magnetic disk drive or an optical disk drive, is a non-volatile storage device for storing data and instructions for use by processor 510. Mass storage device 530 can store the system software for implementing embodiments of the present technology for purposes of loading that software into memory 520.

Portable storage device 540 operates in conjunction with a portable non-volatile storage medium, such as a floppy disk, compact disk or digital video disc, to input and output data and code to and from the computing system 500 of FIG. 5. The system software for implementing embodiments of the present technology may be stored on such a portable medium and input to the computing system 500 via the portable storage device 540.

Input devices 560 provide a portion of a user interface. Input devices 560 may include an alphanumeric keypad, such as a keyboard, for inputting alphanumeric and other information, or a pointing device, such as a mouse, a trackball, stylus, or cursor direction keys. Additionally, the system 500 as shown in FIG. 5 includes output devices 550. Suitable output devices include speakers, printers, network interfaces, and monitors.

Graphics display 570 may include a liquid crystal display (LCD) or other suitable display device. Graphics display 570 receives textual and graphical information, and processes the information for output to the display device.

Peripherals 580 may include any type of computer support device to add additional functionality to the computing system. Peripheral device(s) 580 may include a modem or a router.

The components contained in the computing system 500 of FIG. 5 are those typically found in computing systems that may be suitable for use with embodiments of the present technology and are intended to represent a broad category of such computer components that are well known in the art. Thus, the computing system 500 can be a personal computer, hand held computing system, telephone, mobile computing system, workstation, server, minicomputer, mainframe computer, or any other computing system. The computer can also include different bus configurations, networked platforms, multi-processor platforms, etc. Various operating systems can be used including UNIX, Linux, Windows, Macintosh OS, Palm OS, and other suitable operating systems.

Some of the above-described functions may be composed of instructions that are stored on storage media (e.g., computer-readable medium). The instructions may be retrieved and executed by the processor. Some examples of storage media are memory devices, tapes, disks, and the like. The instructions are operational when executed by the processor to direct the processor to operate in accord with the technology. Those skilled in the art are familiar with instructions, processor(s), and storage media.

It is noteworthy that any hardware platform suitable for performing the processing described herein is suitable for use with the technology. The terms "computer-readable storage medium" and "computer-readable storage media" as used herein refer to any medium or media that participate in providing instructions to a CPU for execution. Such media can take many forms, including, but not limited to, non-volatile media, volatile media and transmission media. Non-volatile media include, for example, optical or magnetic disks, such as a fixed disk. Volatile media include dynamic memory, such as system RAM. Transmission media include coaxial cables, copper wire and fiber optics, among others, including the wires that comprise one embodiment of a bus. Transmission media can also take the form of acoustic or light waves, such as those generated during radio frequency (RF) and infrared (IR) data communications. Common forms of computer-readable media include, for example, a floppy disk, a flexible disk, a hard disk, magnetic tape, any other magnetic medium, a CD-ROM disk, digital video disk (DVD), any other optical medium, any other physical medium with patterns of marks or holes, a RAM, a PROM, an EPROM, an EEPROM, a FLASHEPROM, and any other memory chip or data exchange adapter, a carrier wave, or any other medium from which a computer can read.

Various forms of computer-readable media may be involved in carrying one or more sequences of one or more instructions to a CPU for execution. A bus carries the data to system RAM, from which a CPU retrieves and executes the instructions. The instructions received by system RAM can optionally be stored on a fixed disk either before or after execution by a CPU.

Computer program code for carrying out operations for aspects of the present technology may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The corresponding structures, materials, acts, and equivalents of all means or step plus function elements in the claims below are intended to include any structure, material, or act for performing the function in combination with other claimed elements as specifically claimed. The description of the present technology has been presented for purposes of illustration and description, but is not intended to be exhaustive or limited to the invention in the form disclosed. Many modifications and variations will be apparent to those of ordinary skill in the art without departing from the scope and spirit of the invention. Exemplary embodiments were chosen and described in order to best explain the principles of the present technology and its practical application, and to enable others of ordinary skill in the art to understand the invention for various embodiments with various modifications as are suited to the particular use contemplated.

Aspects of the present technology are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present technology. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

The invention claimed is:

1. An antenna array, comprising:

a substrate;

at least four linearly aligned columns disposed on the substrate, each of the at least four linearly aligned columns comprising a plurality of elements, each of the plurality of elements producing an elliptically polarized wave having an eccentricity value, the elliptically polarized wave traveling along a direction of propagation, each of the plurality of elements of a first column of the at least four linearly aligned columns being clocked around their direction of propagation at a zero degrees, each of the plurality of elements of a second column of the at least four linearly aligned columns being identically clocked around their direction of propagation at a ninety degrees relative to the first column, each of the plurality of elements of a third column of the at least four linearly aligned columns being identically clocked around their direction of propagation at a ninety degrees relative to the second column, and each of the plurality of elements of a fourth column of the at least four linearly aligned columns being identically clocked around their direction of propagation at a ninety degrees relative to the third column such that a combined output of the antenna array is substantially circularly polarized, the antenna array is configured to be isolated in a unique fixed direction relative to other adjacent arrays to minimize signal overlap with the other adjacent arrays and eliminate use of explicit client channel state information (CSI) feedback; and means for compensating for a phase shift in the combined output, caused by clocking of the plurality of elements, the means comprising a feed for each of the plurality of elements, the feed having a length that is selected to induce a phase correction that maintains the plurality of elements as if the clocking had not been performed, while reducing array ellipticity to an acceptable level due to the clocking of the plurality of elements.

2. The antenna array according to claim 1, further comprising a processor executing phase shift logic stored in memory to modify the combined output of the plurality of elements to further compensate for the phase shift.

3. The antenna array according to claim 1, further comprising a processor controlling a capacitor or an inductor to modify the combined output of the plurality of elements to further compensate for the phase shift, the capacitor or inductor being electrically coupled to the plurality of elements.

4. The antenna array according to claim 1, wherein a processor further executes instructions to detect the phase shift in the combined output, due to physical clocking of the plurality of the elements of the array, the phase shift thereby causing interference in signals transmitted or received by the antenna array.

5. The antenna array according to claim 1, wherein each of the plurality of elements are clocked at 90 degrees relative to one another.

6. The antenna array according to claim 1, wherein the clocking of an N number of elements is calculated as 360/N.

7. The antenna array according to claim 1, wherein the plurality of elements of the array is disposed on a three-dimensional surface of the substrate.

8. The antenna array according to claim 1, wherein the plurality of elements of the array is disposed on a two-dimensional surface of the substrate.

9. A wireless device, comprising an antenna array disposed on a substrate, the antenna array comprising at least four linearly aligned columns disposed on the substrate, each of the at least four linearly aligned columns comprising a plurality of elements, each of the plurality of elements producing an elliptically polarized wave having a polarization vector that is perpendicular to a major axis of the elliptically polarized wave, each of the plurality of elements of a first column of the at least four linearly aligned columns being identically clocked around their direction of propagation at a zero degrees, each of the plurality of elements of a second column of the at least four linearly aligned columns being identically clocked around their direction of propagation at a ninety degrees relative to the first column, each of the plurality of elements of a third column of the at least four linearly aligned columns being identically clocked around their direction of propagation at a ninety degrees relative to the second column, and each of the plurality of elements of a fourth column of the at least four linearly aligned columns being identically clocked around their direction of propagation at a ninety degrees relative to the third column so that an ellipticity of a combined output of the antenna array is reduced and is substantially circularly polarized, and the antenna array is configured to be isolated in a unique fixed direction relative to other adjacent arrays to minimize signal overlap with the other adjacent arrays and eliminate use of explicit client channel state information (CSI) feedback.

10. The wireless device according to claim 9, wherein the wireless device is a single user multiple-input-multiple-output device.

11. The wireless device according to claim 9, wherein the wireless device is a multiple user multiple-input-multiple-output device.

12. A method executed within a wireless device that comprises a processor and a memory, the processor executing instructions stored in memory to perform the method, comprising:

controlling an antenna array comprising at least four linearly aligned columns disposed on a substrate, each of the at least four of linearly aligned columns comprising a plurality of elements, wherein each of the plurality of elements produces an elliptically polarized wave having an eccentricity value, the elliptically polarized wave traveling along a direction of propagation, each of the plurality of elements of a first column of the at least four linearly aligned columns being clocked around their direction of propagation at a zero degrees, each of the plurality of elements of a second column of the at least four linearly aligned columns being identically clocked around their direction of propagation at a ninety degrees relative to the first column, each of the plurality of elements of a third column of the at least four linearly aligned columns being identically clocked around their direction of propagation at a ninety degrees relative to the second column, and each of the plurality of elements of a fourth column of the at least four linearly aligned columns being identically clocked around their direction of propagation at a ninety degrees relative to the third column such that a combined output of the antenna array is substantially circularly polarized, and wherein the antenna array is isolated in a unique fixed direction relative to other adjacent arrays to minimize signal overlap with the other adjacent arrays and eliminate use of explicit client channel state information (CSI) feedback.

13. The method according to claim 12, further comprising: detecting a phase shift in the combined output, due to physical clocking of the elements of the array, the phase shift thereby causing interference in signals transmitted or received by the wireless device; and compensating for a phase shift by executing phase shift logic stored in the memory to modify the combined output of the plurality of elements to remove or reduce the phase shift.

14. The method according to claim 13, further comprising controlling, by the processor, a capacitor or an inductor to modify the combined output of the plurality of elements to remove or reduce the phase shift, the capacitor or inductor being electrically coupled to the plurality of elements.

15. The method according to claim 12, further comprising: detecting a phase shift in the combined output, due to physical clocking of the elements of the array, the phase shift thereby causing interference in signals transmitted or received by the wireless device; and compensating for a phase shift by executing phase shift logic stored in the memory to induce time delay.

16. An antenna, comprising:

a processor; and a memory for storing executable instructions, the processor executing the instructions stored in memory to:

control an antenna array comprising at least four linearly aligned columns, each of the at least four linearly aligned columns comprising a plurality of elements, each of the plurality of elements producing an elliptically polarized wave having an eccentricity value, the elliptically polarized wave traveling along a direction of propagation, each of the plurality of elements of a first column of the at least four linearly aligned columns that are identically clocked around their direction of propagation at a zero degrees, each of the plurality of elements of a second column of the at least four linearly aligned columns is identically clocked around their direction of propagation at a ninety degrees relative to the first column, each of the plurality of elements of a third column of the at least four linearly aligned columns is identically clocked around their direction of propagation at a ninety degrees relative to the second column, and each of the plurality of elements of a fourth column of the at least four linearly aligned columns is identically clocked around their direction of propagation at a ninety degrees relative to the third column such that a combined output of the antenna array is substantially circularly polarized, each of the plurality of elements:

is associated with a feed; and the feed has a length that is selected to induce a phase correction that maintains the plurality of elements as if clocking had not been performed, while reducing array ellipticity to an acceptable level due to the clocking of the plurality of elements, and wherein the antenna array is configured to be isolated in a unique fixed direction relative to other adjacent arrays to minimize signal overlap with the other adjacent arrays and eliminate use of explicit client channel state information (CSI) feedback.

17. The antenna according to claim 16, wherein the processor is further configured to execute phase shift logic stored in the memory to modify the combined output of the plurality of elements to remove or reduce phase shift.

18. The antenna according to claim 17, wherein the processor is further configured to control a capacitor or an inductor to modify the combined output of the plurality of elements to remove or reduce the phase shift, the capacitor or inductor being electrically coupled to the plurality of elements.

* * * * *